United States Patent [19]

Erard

[11] Patent Number: 4,548,512

[45] Date of Patent: Oct. 22, 1985

[54] WATCH WITH INDICATOR OF LUNAR PHASES

[76] Inventor: Raoul-Henri Erard, 82, Boulevard des Endroits, 2300-La Chaux-de-Fonds, Switzerland

[21] Appl. No.: 543,033

[22] Filed: Oct. 18, 1983

[30] Foreign Application Priority Data

Oct. 27, 1982 [CH] Switzerland ..... 6262/82

[51] Int. Cl.[4] ..... G04B 19/26

[52] U.S. Cl. ..... 368/15; 368/18

[58] Field of Search ..... 368/16–18, 368/19, 20, 15

[56] References Cited

U.S. PATENT DOCUMENTS

| | | | |
|---|---|---|---|
| 246,061 | 8/1981 | Blair | 368/16 |
| 508,467 | 11/1893 | Clark | 368/18 |
| 1,126,214 | 1/1915 | Herschede | 368/18 |
| 1,153,492 | 9/1915 | Hoitinga | 368/16 |
| 3,775,965 | 12/1973 | Besson et al. | 368/35 |

FOREIGN PATENT DOCUMENTS

| | | | |
|---|---|---|---|
| 2944747 | 5/1981 | Fed. Rep. of Germany | 368/19 |
| 348040 | 3/1905 | France . | |
| 2500181 | 8/1982 | France . | |
| WO82/03472 | 10/1982 | PCT Int'l Appl. . | |
| 265569 | 3/1950 | Switzerland . | |

*Primary Examiner*—Bernard Roskoski

*Attorney, Agent, or Firm*—Young & Thompson

[57] ABSTRACT

Watch with moon phases indicator constituted by a moon phases indicating member (14) partly appearing through the moon wicket (13A) of a moon phases indicating member (13) in such a way that it represents the shape of the moon as a function of the quarter which it occupies relative to the time displayed by the hour indicating members.

7 Claims, 2 Drawing Figures

WATCH WITH INDICATOR OF LUNAR PHASES

Watches are known which comprise an indicator of the moon phases. All these indicating elements comprise different figures of the moon which pass under a wicket of the dial.

The watch according to the invention differentiates from the known watches by the fact that the representation of the moon constantly changes in form as a function of the time in order to reach a circular, full form after each period corresponding to a lunar month, and that the representation of the moon can itself carry out a rotation around an axis during a period of time corresponding to two successive passages of the moon at the meridian of a determined place.

Figure 1:
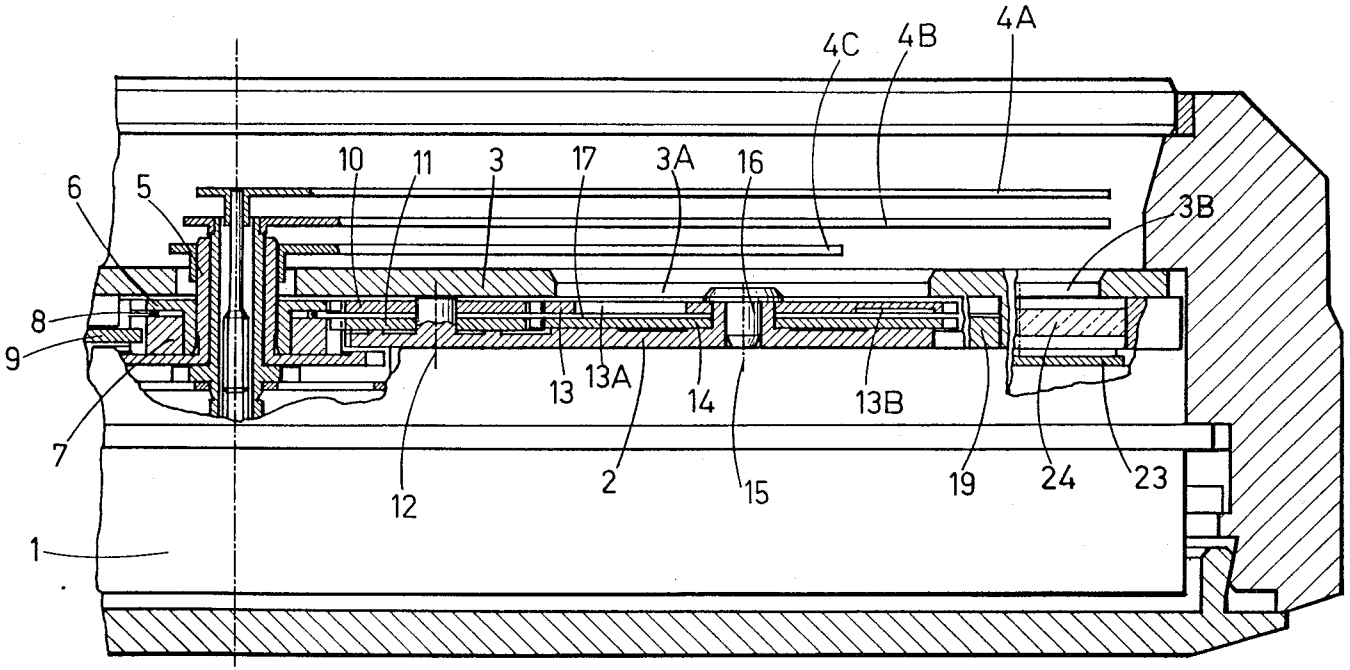
Figure 2:
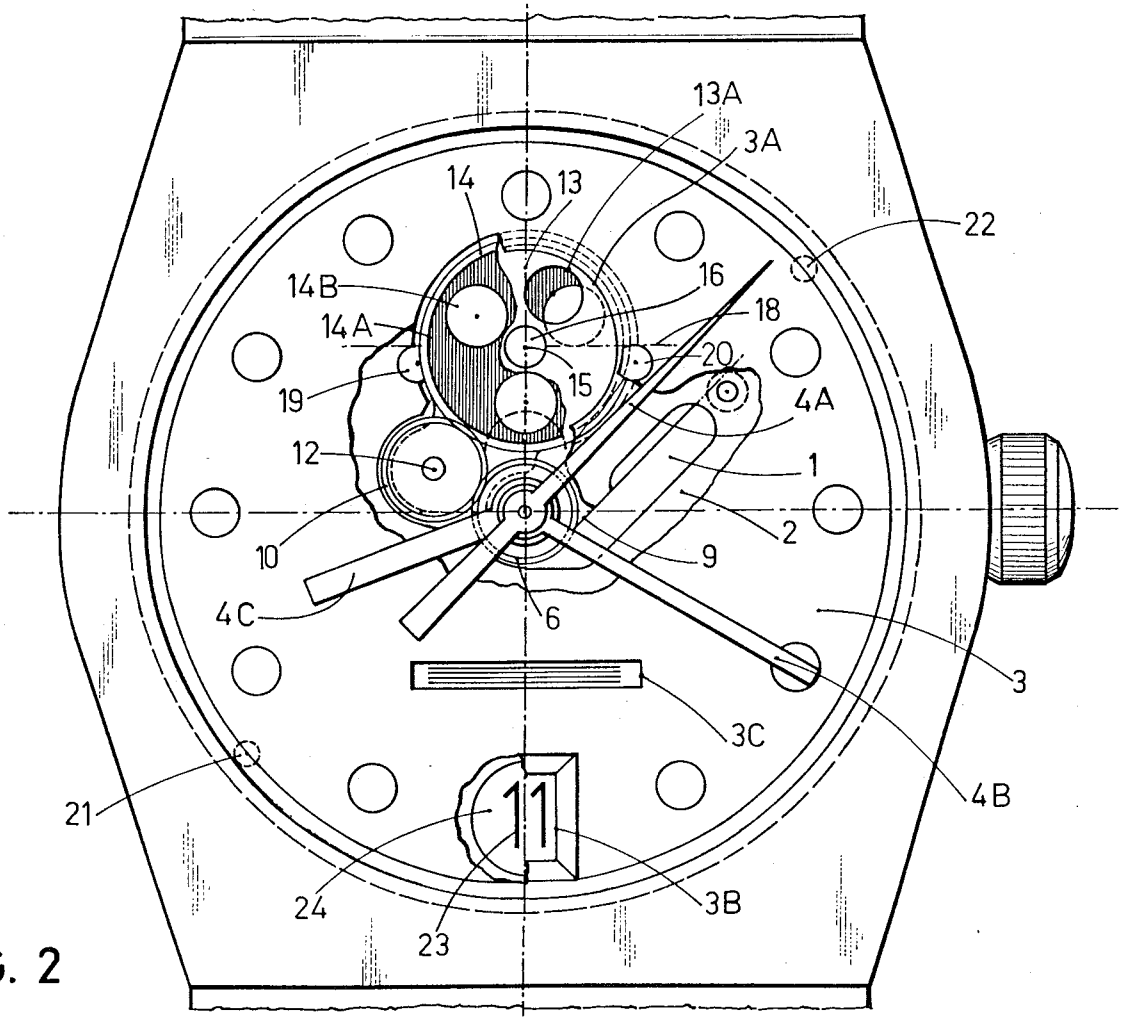

FIGS. 1 and 2 show, respectively in cross-section and plan view, a non-limiting embodiment of a watch according to the invention.

In FIG. 1, there is shown the movement 1, which can be a mechanical movement of an electronic movement, and plate 2 on which the dial 3 is fixed and above which dial the second hand 4A, minute hand 4B and hour hand 4C move. The hour wheel 5, which makes one revolution every twelve hours, carries a driven moon pinion 6 having 43 teeth, around which a moon phases pinion 7 also having 43 teeth is freely pivoted, said pinion 7 being connected to the hour wheel by an annular friction spring 8. A spring click of the pinion of the moon phases 9 stops this latter when the hour wheel is displaced anti-clockwise, for example during a negative time setting. The moon gear 10 and the moon phases gear 11 pivot around the axis 12 and are used essentially to determine the rotation direction of the indicating member of the moon phases pivoting around the axis 15, maintained by the pin of the indicating member 16 and appearing in the circular wicket 3A of the dial.

This indicating member comprises the moon disk 13 with 89 teeth comprising the circular moon wicket 13A and a recess 13B (essentially for the electronic movements). This moon disk accomplishes a revolution in 89,413.95 seconds as a function of the gear ratios chosen, that is by being shorter by 16.05 seconds than the theoretical value of 89430 seconds, which is 24 h.50'30" of the period between two successive passages of the moon at a meridian of a phase, which is quite acceptable for this kind of indicator. The moon phases disk 14 with 90 teeth carries out an angular displacement (negative) of 120° relative to the moon disk during a period of one lunar month, that is during 29 days 12 hours 44' 2.8" with a quite acceptable precision of 0.2 per thousand (error due to the gearing ratio chosen). The upper face of the moon phases disk comprises a bright portion (colour of the moon) on which three equidistant circles are marked, which correspond by their sizes to the moon wicket of a dark colour (colour of the sky). The colour of the upper face of the moon disk is assorted and similar to that of the moon circles 14B in such a manner that, when the moon wicket is completely superimposed to a moon circle, no moon image is visible (new moon), then simultaneously and proportionally to the advance of the days, the waxing moon appears and regularly and constantly changes its shape until appearing full, two moon circles being thus tangent to the periphery of the moon wicket, only during the day when the moon is full.

A coloured horizon filter 17, centered by slots 19 and 20, determines a zone situated under the horizon line 18 so that the portion of the moon which is visible in the moon wicket takes a particular colour when it is situated under the horizon. On the other hand, this filter is extended between the gears and the pinions in order to avoid any interference between the upper and the lower gearings, this achieving a particularly flat mechanism.

Among other particular working details, should be noted the dial foot holes 21 and 22 to fix by means of tubes the plate onto the movement, said plate being able to also carry in its thickness on the one hand a magnifying-glass 24 enlarging the indications borne by the date indicator 23 appearing in the wicket 3B and, on the other hand, a mark appearing in the wicket 3C.

The indicating member described by way of example constitutes a moving system perfectly reproducing the moon movement relative to the earth as well as the evolution of its shape during its various phases.

The synchronization is carried out by the time setting members of the movement by acting in the positive direction for obtaining the relative position of the moon wicket relative to the hands, and then by acting in the negative direction for adjusting the moon shape according to the quarter occupied, the definitive resetting being thus positively carried out. This expedient has the advantage of not necessitating particular correcting members. In such a case, it can be thus provided to drive both friction pinions on the hour wheel with a particular correcting device selectively blocking, either the moon disk, or the moon phases disk. Finally, it is possible to modify the precision of the mechanism described by further modifying the ratios and by using differential gearings.

A simplified embodiment of this moon indicating device can be provided by omitting the moon movement, the moon wicket being directly opened through the dial plate, and the moon phases disk can be concentric to the switch and driven by a satellite pinion carried by the hour wheel and engaging on the other hand fixed teeth.

Finally, a particular embodiment can have two indicating members constituted by rings comprising internal teeth pivoting around a core and driven each by a pinion carried by the hour wheel. The center of the moon thus follows a path constantly away from the center of the dial and of the switch, but having a revolution center excentric to the switch. The appearance of the dial thus obtained can be modified as desired by choosing a determined moon diameter and a plus or minus great number of moon circles for the lower member.

What I claim is:

1. Watch with moon phases indicator and a movement, comprising two indicator members which are superposed and parallel to the movement, the lower member having a dark circle on its upper face that represents the color of the night sky and a bright surface surrounding said dark circle, the upper member having a circular hole through which said dark circle is visible and a dark surface surrounding said hole, and means for simultaneously rotating said indicator members at a speed such that the upper member completes one full revolution in the time between two passages of the moon past the meridian of the sky, and such that the lower member rotates at a speed that differs from the speed of the upper member by an amount such that the portion of said dark circle that is visible through said hole leaves exposed through said hole only a portion of said bright surface that varies as the phases of the moon.

2. Watch as claimed in claim 1, and means defining an artificial horizon above which said portion of said bright surface, visible through said hole, rises and sets with the rising and setting of the moon.

3. Watch according to claim 1, in which said members are flat disks, and means mounting said flat disks for rotation about a common axis.

4. Watch as claimed in claim 3, which has hands rotatable about a second axis spaced from and parallel to the first-mentioned axis.

5. Watch as claimed in claim 1, having an hour hand and an hour wheel turning said hour hand, a pinion secured to the hour wheel, a moon gear driven by said pinion and driving said moon gear, said moon gear driving said upper member, a pinion frictionally driven by said hour wheel, and a moon phase gear driven by said frictionally driven pinion, said moon phase gear driving the lower of said members.

6. Watch as claimed in claim 5, in which said moon gear and said moon phase gear are mounted for rotation about a common axis.

7. Watch as claimed in claim 5, and means permitting rotation of said frictionally driven pinion in only one direction.

* * * * *